US009920573B1

(12) United States Patent
Branton

(10) Patent No.: US 9,920,573 B1
(45) Date of Patent: Mar. 20, 2018

(54) SUBTERRANEAN WELL DRILLING METHOD

(71) Applicant: Christopher A. Branton, Bossier City, LA (US)

(72) Inventor: Christopher A. Branton, Bossier City, LA (US)

( * ) Notice: Subject to any disclaimer, the term of this patent is extended or adjusted under 35 U.S.C. 154(b) by 711 days.

(21) Appl. No.: 14/488,416

(22) Filed: Sep. 17, 2014

Related U.S. Application Data

(60) Provisional application No. 61/879,703, filed on Sep. 19, 2013.

(51) Int. Cl.
*E21B 7/00* (2006.01)
*E21B 33/06* (2006.01)
*E21B 47/00* (2012.01)

(52) U.S. Cl.
CPC ..... *E21B 7/00* (2013.01); *E21B 33/06* (2013.01); *E21B 47/00* (2013.01)

(58) Field of Classification Search
CPC ..... E21B 33/06; E21B 7/00; E21B 47/00
See application file for complete search history.

(56) References Cited

U.S. PATENT DOCUMENTS 3,897,824 A * 8/1975 Fisher ..... E21B 33/06 166/188
4,018,276 A * 4/1977 Bode ..... E21B 33/06 166/183
4,030,354 A * 6/1977 Scott ..... E21B 33/06 73/152.01
4,553,591 A * 11/1985 Mitchell ..... E21B 33/03 166/86.2
4,554,976 A * 11/1985 Hynes ..... E21B 17/06 166/337
6,152,225 A * 11/2000 Young ..... E21B 47/1025 166/250.08
6,390,194 B1 * 5/2002 Young ..... E21B 33/06 166/250.08
7,062,960 B2 * 6/2006 Couren ..... E21B 33/061 73/152.51
7,086,474 B1 * 8/2006 Trevithick ..... E21B 33/06 166/379
7,401,654 B2 * 7/2008 Franklin ..... E21B 47/1025 166/250.08
7,624,792 B2 * 12/2009 Wright ..... E21B 33/06 137/68.11
7,647,973 B2 * 1/2010 Minassian ..... E21B 17/1007 166/250.08
8,403,053 B2 * 3/2013 Judge ..... E21B 33/0355 166/250.01

(Continued)

*Primary Examiner* — Nicole Coy
(74) *Attorney, Agent, or Firm* — R. Keith Harrison

(57) ABSTRACT

A drill string coupling and uncoupling method includes forming a well bore by conducting a drilling operation using a drill string having a first drill string segment and a second drill string segment detachably coupled to the first drill string segment; immobilizing the second drill string segment in the well bore; uncoupling the first drill string segment from the second drill string segment; at least partially retracting the first drill string segment in the well bore away from the second drill string segment; reinserting the first drill string segment in the well bore to the second drill string segment; and re-coupling the first drill string segment to the second drill string segment.

19 Claims, 8 Drawing Sheets

(56) References Cited

U.S. PATENT DOCUMENTS

| | | | | |
|---|---|---|---|---|
| 9,151,127 | B1 * | 10/2015 | Branton | E21B 23/004 |
| 9,470,082 | B1 * | 10/2016 | Williams | E21B 47/00 |
| 9,506,312 | B2 * | 11/2016 | Williams | E21B 33/061 |
| 2010/0006340 | A1 * | 1/2010 | Houston | E21B 21/12<br>175/57 |
| 2016/0123140 | A1 * | 5/2016 | Bedouet | E21B 17/025<br>166/250.01 |
| 2017/0009548 | A1 * | 1/2017 | Williams | E21B 33/061 |

* cited by examiner

SUBTERRANEAN WELL DRILLING METHOD

CROSS-REFERENCE TO RELATED APPLICATIONS

This application claims the benefit of U.S. provisional application Ser. No. 61/879,703, filed Sep. 19, 2013 and entitled SUBTERRANEAN WELL DRILLING METHOD, which provisional application is incorporated by reference herein in its entirety.

FIELD

Illustrative embodiments of the disclosure relate to the drilling of subterranean wells such as oil and gas wells. More particularly, illustrative embodiments of the disclosure relate to a subterranean drill string coupling and uncoupling method which expedites drilling operations interrupted by blowout preventer (BOP) testing.

BACKGROUND

The background description provided herein is solely for the purpose of generally presenting the context of the illustrative embodiments of the disclosure. Aspects of the background description are neither expressly nor impliedly admitted as prior art against the claimed subject matter.

Subterranean oil and gas wells are formed by drilling a well bore through one or more subterranean formations which contain hydrocarbons that are to be extracted from the well. The well bore is typically drilled into the ground by operation of a drilling rig which is placed at the ground surface. A drill string fitted with a drill bit is assembled at the drilling rig and the drill bit is rotated and cuts the well bore into a soil, rock or other material or medium beneath the ground and through the hydrocarbon formation or formations. During or after drilling, a well casing may be installed in the well bore and is typically perforated at the location of each formation. A production string is inserted in the well bore to facilitate flow of the hydrocarbons under pressure from the hydrocarbon formation or formations, through the perforations and the production string to the surface of the well.

During the drilling operation, drilling fluid is typically pumped from the well surface through the drill string and is ejected from the drill bit at the cutting end of the string. The ejected drilling fluid then returns to the well surface through the annulus between the drill string and the well bore and is again pumped through the drill string, forming a continuous circulation loop. At the cutting end of the drill string, the pressurized and ejected drilling fluid strikes the medium, enhancing the cutting action of the drill bit and cooling and lubricating the bit. The lubricating effect of the drilling fluid also facilitates disengagement and removal or extraction of the drill bit from the medium and removal of the drill string from the well bore upon conclusion of the drilling operation.

A blowout preventer (BOP) is a large, specialized valve or similar mechanical device which is typically included in the drill string to release erratic pressures and uncontrolled flow of formation fluids from the well during drilling. Blowout preventers may also prevent tubing, downhole tools and drilling fluid from being blown out of the well bore when a blowout threatens. Therefore, blowout preventers are important to the safety of crew, rig and environment and to the monitoring and maintenance of well integrity. Blowout preventers are typically located at the mud line of the well bore, at a depth of 200-10.000 feet.

In well drilling operations, tests are periodically performed to corroborate the integrity of the BOP and verify that the BOP has the capacity to withstand the reservoir fluids and pressures in case of a surface blowout. In BOP testing, it may be required that the entire drill string be removed from the well bore and the BOP tested at the well surface, after which the drill string is reinserted in the well bore to resume drilling. The process of removing the drill string, testing the BOP and reinserting the drill string to resume drilling operations may take 2~3 days, significantly interrupting the drilling operation and delaying ultimate production of hydrocarbons from the well.

Therefore, a subterranean drill string coupling and uncoupling method which expedites drilling operations interrupted by blowout preventer (BOP) testing is needed.

SUMMARY

Illustrative embodiments of the disclosure are generally directed to a subterranean drill string coupling and uncoupling method which expedites drilling operations interrupted by blowout preventer (BOP) testing. An illustrative embodiment of the subterranean drill string coupling and uncoupling method includes forming a well bore by conducting a drilling operation using a drill string having a first drill string segment and a second drill string segment detachably coupled to the first drill string segment; immobilizing the second drill string segment in the well bore; uncoupling the first drill string segment from the second drill string segment; at least partially retracting the first drill string segment in the well bore away from the second drill string segment; reinserting the first drill string segment in the well bore to the second drill string segment; and re-coupling the first drill string segment to the second drill string segment.

BRIEF DESCRIPTION OF THE DRAWINGS

Illustrative embodiments of the disclosure will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable users skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. As used herein, relative terms such as "upper", "lower" and "downwardly" are intended to be used in a non-limiting descriptive sense to describe some possible applications of the methods. Other applications of the methods in which such relative terms do not apply are possible. As used herein, "proximal" means closer to a well surface and "distal" means further from a well surface.

Figure 1:
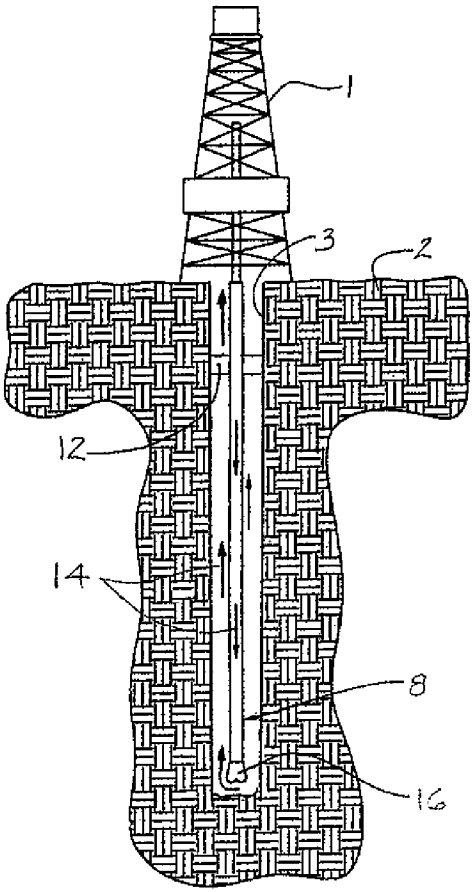
FIG. 1 is a side view of a drilling rig and a drill string extending into a well bore beneath the drilling rig in implementation of an illustrative embodiment of the subterranean drill string coupling and uncoupling method.
Figure 2:
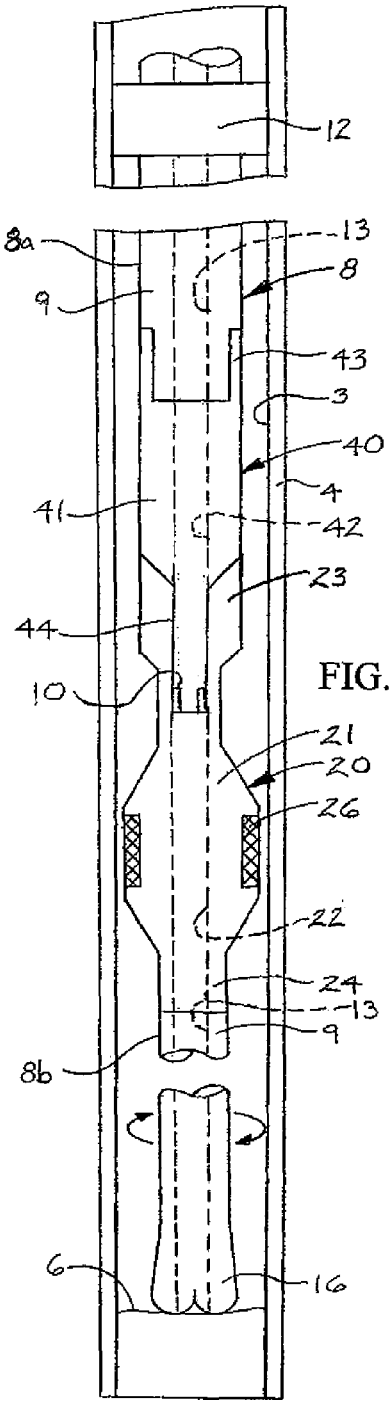
FIG. 2 is a longitudinal sectional view of a portion of the well bore, with the drill string fitted with a blowout preventer and inserted in the well bore and an on/off tool and a hang off tool coupling a lower segment to an upper segment of the drill string during a drilling operation.

Referring to the drawings, implementation of an illustrative embodiment of the subterranean drill string coupling and uncoupling method is shown. As illustrated in FIG. 1, in some embodiments, a drilling rig 1 may be erected over a hydrocarbon formation 2. In other embodiments, the method may be implemented on an offshore drilling rig. A drill string 8 having a drill string bore 13 (FIG. 2) is assembled at and extends from the drilling rig 1 into a subterranean well bore 3 in the hydrocarbon formation 2 beneath the drilling rig 1. In some applications, the well bore 3 may be vertical, as illustrated. In other applications, the well bore 3 may be non-vertical (horizontal or any angle between vertical and horizontal). In some applications, the well bore 3 may include some segments which are vertical and other segments which are non-vertical. As illustrated in FIG. 2, a well casing 4 may line the well bore 3. The lower end of the drill string 8 is terminated by a drill head 16. Rotation of the drill head 16 in the well bore 3, typically in the conventional manner, facilitates formation of the well bore 3 as the drill head 16 drills at the working surface 6. A blowout preventer (BOP) 12 is immobilized in the well bore 3. The drill string 8 extends through the BOP 12. The BOP 12 releases erratic pressures and uncontrolled flow of formation fluids from the well bore 3 during the drilling operation, as is known by those skilled in the art.

The drill string 8 includes an upper drill string segment 8*a* and a lower drill string segment 8*b*. An on/off tool 40 is provided on a lower or distal end of the upper drill string segment 8*a*. A hang off tool 20 is provided on an upper end of the lower drill string segment 8*b*. The hang off tool 20 is normally coupled to the on/off tool 40 via a pinned, threaded or other connection known by those skilled in the art to detachably attach the lower drill string segment 8*b* to the upper drill string segment 8*a* and the drill string 8 in one piece during the drilling operation. The hang off tool 20 and lower drill string segment 8*b* attached thereto can be selectively suspended in the well bore 3 and the on/off tool 40 uncoupled from the hang off tool 20 to separate the upper drill string segment 8*a* from the lower drill string segment 8*b* and retrieve the upper drill string segment 8*b* to the well surface for purposes which will be hereinafter described.

As further illustrated in FIG. 2, the on/off tool 40 may include an on/off tool body 41 having an on/off tool top sub 43 which is attached to the upper drill string segment 8*a* such as via a threaded connection, for example and without limitation, and an on/off tool bottom sub 44 to which the hang off tool 20 is coupled according to the knowledge of those skilled in the art. An on/off tool bore 42 extends through the on/off tool body 41 and communicates with the drill string bore 13 of the upper drill string segment 8*a*.

The hang off tool 20 may include a hang off tool body 21 having a hang off tool top sub 23 which is detachably coupled to the on/off tool bottom sub 44 of the on/off tool 40 and a hang off tool bottom sub 24 to which the lower drill string segment 8*b* is attached. A hang off tool bore 22 extends through the hang off tool body 21 and communicates with the on/off tool bore 42 of the on/off tool 40 and the drill string bore 13 of the lower drill string segment 8*b*. The hang off tool body 21 may be fitted with expandable and retractable slips 26 which can be selectively extended outwardly to engage the well casing 4 (FIG. 4) upon pressurization of the drill string 8 according to a mechanism which is well known by those skilled in the art.

As illustrated in FIG. 2, in typical implementation of the method, the hang off tool 20 may be strategically placed within the drill string 8 such that the hang off tool 20 is disposed within the well casing 4 during drilling. Throughout the drilling operation, the drill head 16 rotates at the working surface 6 as drilling fluid 14 (FIG. 1) is circulated from the well surface through the drill string 8 and discharged at the drill head 16, and flows back to the well surface through the well annulus between the drill string 8 and the well casing 4. The stationary BOP 12 may be located within the well bore 3 at a depth of typically from about 200 feet to about 10,000 feet during the drilling operation, or at the mud line between fluid and mud in the well bore 3 as is known by those skilled in the art.

Periodically, it may be necessary to subject the BOP 12 to testing to ensure optimal operation of the BOP. Accordingly, the lower drill string segment 8*b* is suspended or immobilized in the well bore 3 as the upper drill string segment 8*a* is pulled up or at least partially retracted in the well bore 3 to facilitate testing of the BOP 12 through the on/off tool 40 as the BOP 12 remains in the well bore 3, as will be hereinafter described with respect to FIGS. 3-5 and 9. After testing of the BOP 12 is completed, the upper drill string segment 8*a* is lowered or reinserted through the BOP 12 in the well bore 3 and again coupled to the still-suspended or immobilized lower drill string segment 86*b* to resume the drilling operation, as will be hereinafter described with respect to FIGS. 6-8.

Figure 3:
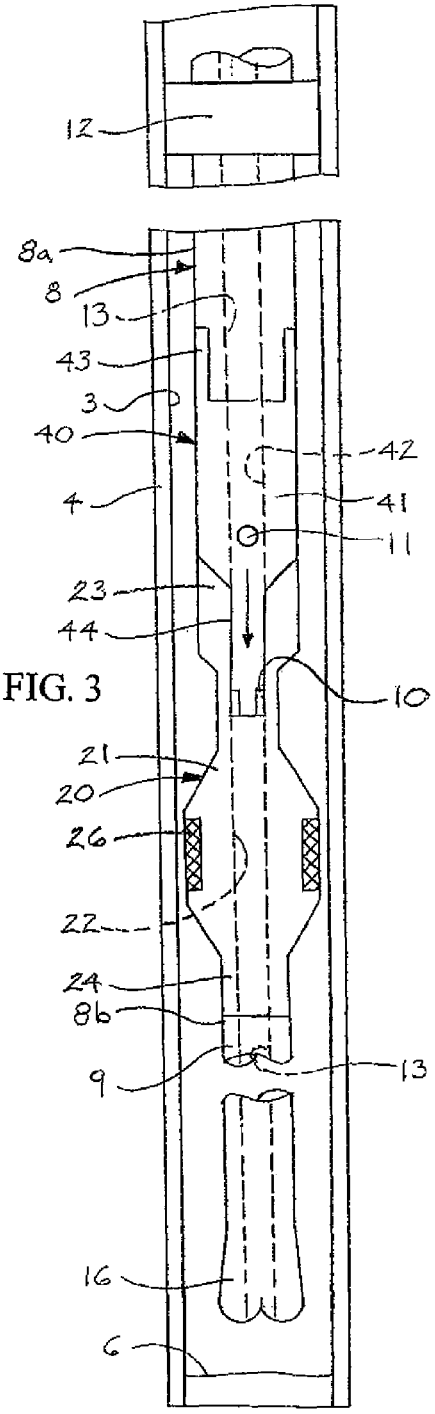
FIG. 3 is a longitudinal sectional view of the well bore, more particularly illustrating dropping of a ball through the drill string and into a ball seat preparatory to suspending the hang off tool and lower drill string segment in the well bore and uncoupling the on/off tool from the hang off tool.
Figure 4:
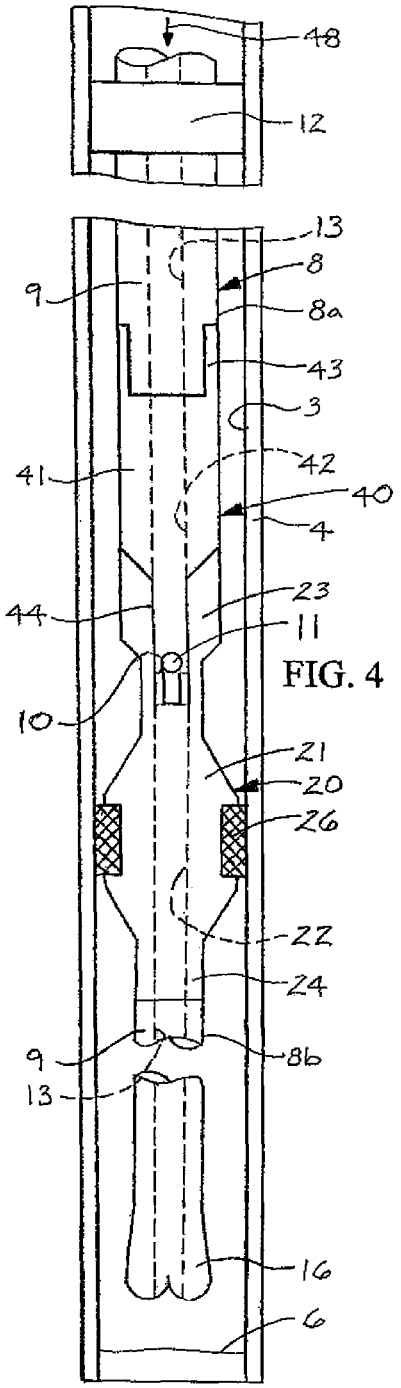
FIG. 4 is a longitudinal sectional view of the well bore, with the ball seated in the ball seat and slips extending outwardly from the hang off tool to engage the well casing and suspend the lower drill string segment in the well bore preparatory to uncoupling the on/off tool from the hang off tool.

At the point during the drilling operation when the BOP 12 is to be subjected to testing, the drilling operation is suspended and circulation of drilling fluid 14 (FIG. 1) is stopped. The drill string 8 may initially be raised or retracted within the well bore 3 to lift or retract the drill head 16 from the working surface 6 until the hang off tool 20 is located a short distance beneath or distal to the BOP 12. As illustrated in FIG. 3, a ball 11 may next be dropped or distributed through the drill string bore 13 of the drill string 8 and seated in a ball seat 10 in the bottom of the on/off tool 40 just above or distal to the hang off tool 20. The ball 11 blocks flow of the drill fluid 14 through the drill string 8 to stop circulation of the drilling fluid 14 and facilitate pressurization 48 (FIG. 4) of the drill string 14 and shifting of the hang off tool 20, resulting in outward expansion or deployment of the slips 26 from the hang off tool body 21 of the hang off tool 20 against the well casing 4, as illustrated in FIG. 4. Accordingly, the slips 26 suspend or immobilize the drill string 8 in the well bore 3. As the pressurization 48 on the drill string 14 is maintained, the lower drill string segment 8*b* of the drill string 8 may be lowered or inserted and hung under the hang-off tool 20 in the well bore 3. In some applications, a weight change may be registered on the indicator at the well surface.

Figure 5:
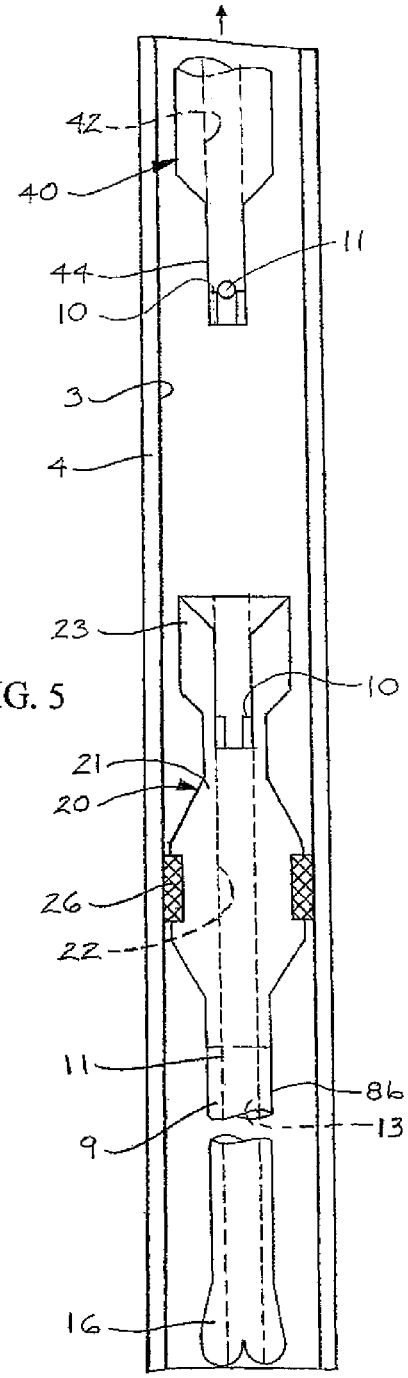
FIG. 5 is a longitudinal sectional view of the well bore, more particularly illustrating uncoupling of the on/off tool from the hang off tool, suspension of the hang off tool and the lower drill string segment below the hang off tool in the well bore and lifting of the upper drill string segment of the drill string above the hang off tool in the well bore for testing of the blowout preventer in the drill string as the blowout preventer remains in the well bore.

As the lower drill string segment 8*b* of the drill string 8 remains suspended beneath or immobilized distal to the hang-off tool 20, the pressurization 48 on the drill string 14 may be maintained and the on/off tool 40 uncoupled from the hang off tool 20, as illustrated in FIG. 5. The on/off tool 40 may be actuated by pressure such that as the pressurization 48 is exerted on the hang off tool 20 such as by setting weight down onto the hang off tool 20 from the upper drill string segment 8*a*, an on/off tool latch (not illustrated) on the on/off tool 40 may disengage from the hang off tool 20 and allow the upper drill string segment 8*a* to separate from the hang off tool 20 at the on/off tool 40, leaving the lower drill string segment 8*b* suspended from or immobilized distal to the hang off tool 20 which is immobilized in the well bore 3. The ball 11 may next be circulated from the ball seat 10 back to the well surface through the drill string bore 13 of the drill string 8 by the circulation of drilling fluid 14 first through the well annulus and then through the drill string bore 13 of the upper drill string segment 8*a*.

Figure 9:
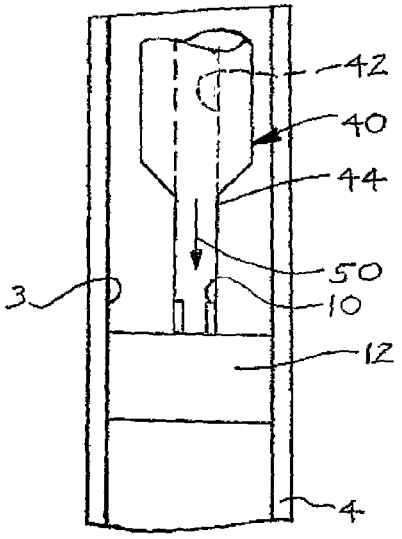
FIG. 9 is a longitudinal sectional view of the well bore with the on/off tool being used to test the blowout preventer as the blowout preventer remains in place in the well bore.
Figure 9:
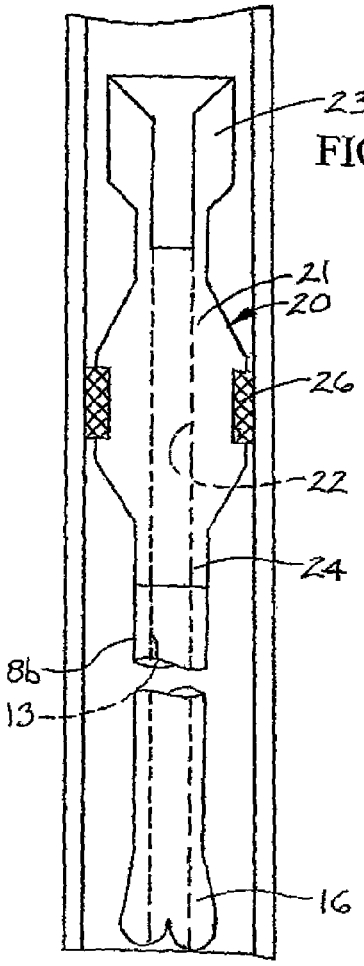

The BOP 12 may be subjected to testing by flowing well fluid 50 from the well surface through the upper drill string segment 8*a* of the drill string 8 and the on/off tool 40, respectively, through the BOP 12 using methods which are known by those skilled in the art. Accordingly, the upper drill string segment 8*a* is raised or retracted in the well bore 3 as the BOP 12 remains in place in the well bore 3 until the upper half of the on/off tool 40 is disposed in fluid communication with the BOP 12, as illustrated in FIG. 9. The on/off tool bottom sub 44 has the same outer diameter (O.D) as that of the minimum size of the variable ram on the BOP 12 which is to be tested. The minimum size of the variable ram on the BOP 12 may then be tested.

Next, the on/off tool 40 may be lowered or inserted into the BOP 12. The upper section of the on/off tool 40 has the same outer diameter (O.D.) as that of the maximum size of the variable ram on the BOP 12 which is to be tested. The maximum size of the variable ram on the BOP 12 may then be tested. The on/off tool 40 may next be raised or retracted above or distal to the blind rams of the BOP 12 and the blind rams tested.

Figure 6:
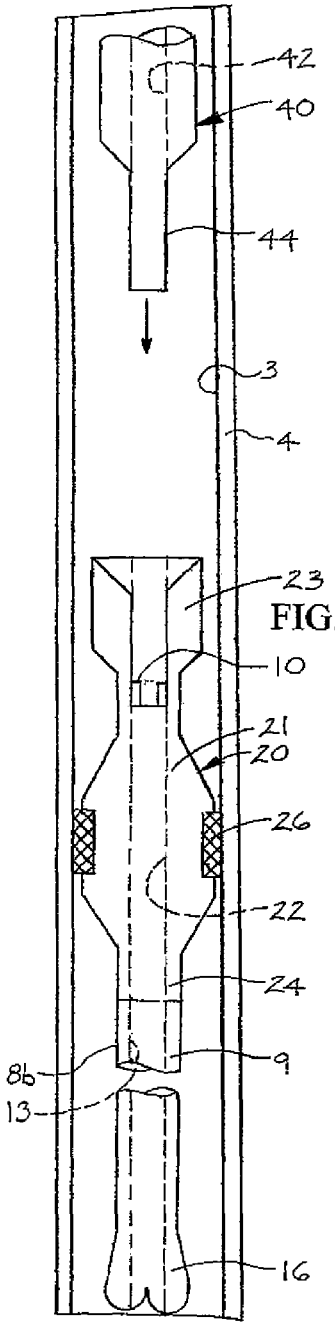
FIG. 6 is a longitudinal sectional view of the well bore, illustrating lowering of the upper drill string segment of the drill string in the well bore with the on/off tool approaching the suspended hang off tool for re-coupling of the upper drill string segment to the lower drill string segment preparatory to resuming the drilling operation.
Figure 7:
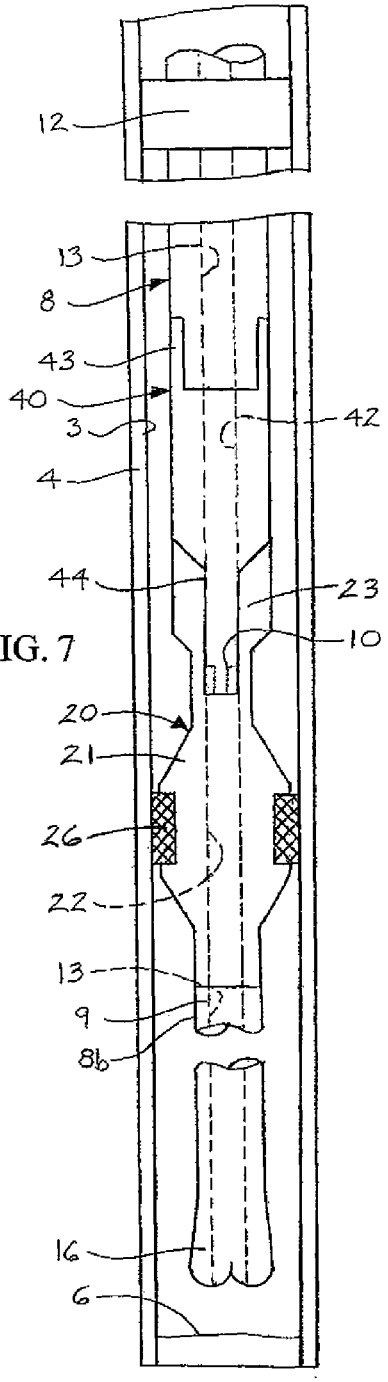
FIG. 7 is a longitudinal sectional view of the well bore, with the on/off tool re-coupled to the hang off tool.
Figure 8:
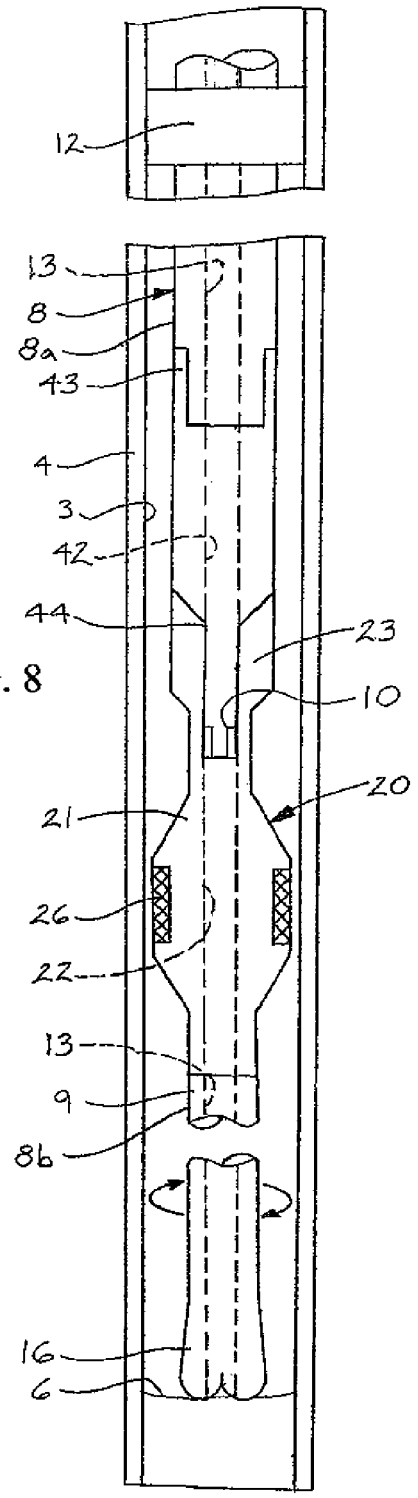
FIG. 8 is a longitudinal sectional view of the well bore with the slips on the hang off tool disengaging the well casing and the drilling operation resumed.

As illustrated in FIGS. 6 and 7, after testing of the BOP 12 is completed, the BOP 12 may be opened and the upper drill string segment 8*a* again lowered or inserted in the well casing 4 through the BOP 12. The on/off tool 40 on the upper drill string segment 8*a* is again coupled with the hang off tool 20 on the suspended or immobilized lower drill string segment 8*b*. The entire drill string 8 may be slightly raised or retracted in the well bore 3 to verity that the weight of the entire drill string 8 registers on the indicator (not illustrated) at the well surface. As illustrated in FIG. 8, the drilling operation may then resume.

Figure 10:
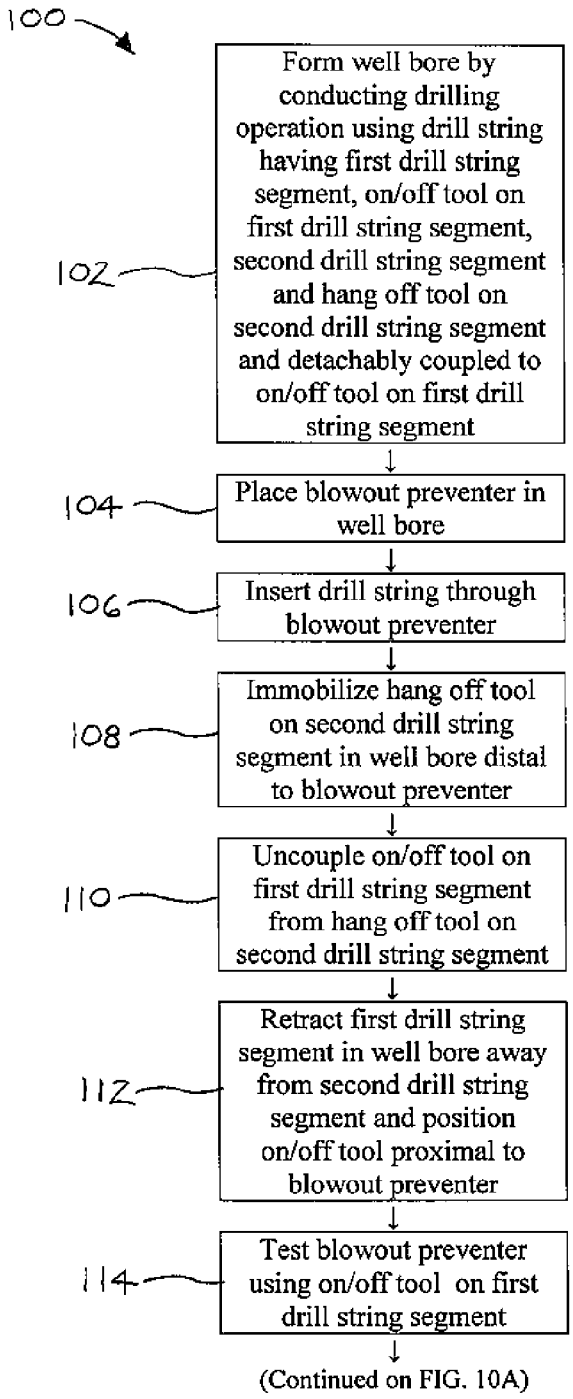
FIG. 10 is a flow diagram of an illustrative embodiment of the subterranean drill string coupling and uncoupling method.
Figure 10A:
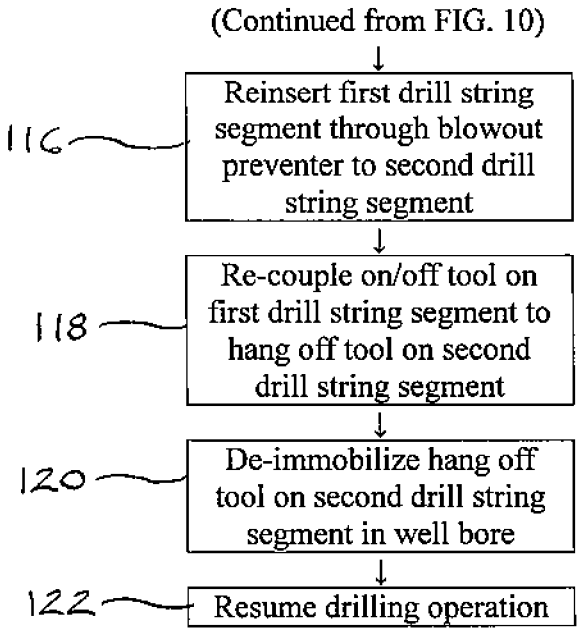
FIG. 10A is a continuation of the method illustrated in FIG. 10.

Referring next to FIGS. 10 and 10A of the drawings, a block diagram an illustrative embodiment of the subterranean drill string coupling and uncoupling method is generally indicated by reference numeral 100. At block 102, a well bore may be formed by conducting a drilling operation using a drill string having a first drill string segment, an on/off tool on the first drill string segment, a second drill string segment and a hang off tool on the second drill string segment and detachably coupled to the on/off tool on the first drill string segment. At block 104, a blowout preventer may be placed in the well bore. At block 106, the drill string may be inserted through the blowout preventer. At block 108, the hang off tool may be immobilized on the second drill string segment in the well bore distal to the blowout preventer. At block 110, the on/off tool on the first drill string segment may be uncoupled from the hang off tool on the second drill string segment. At block 112, the first drill string segment may be retracted in the well bore away from the second drill string segment and the on/off tool positioned proximal to the blowout preventer. At block 114, the blowout preventer may be tested using the on/off tool on the first drill string segment. At block 116, the first drill string segment may be reinserted through the blowout preventer to the second drill string segment. At block 118, the on/off tool on the first drill string segment may be re-coupled to the hang off tool on the second drill string segment. At block 120, the hang off tool on the second drill string segment may be de-immobilized in the well bore. At block 122, the drilling operation may be resumed.

While various illustrative embodiments have been described above, it will be recognized and understood that various modifications can be made and the appended claims are intended to cover all such modifications which may fall within the spirit and scope of the disclosure.

What is claimed is:

1. A subterranean drill string coupling and uncoupling method, comprising:

forming a subterranean well bore by conducting a drilling operation using a drill string having a first drill string segment and a second drill string segment detachably coupled to the first drill string segment and a drill head terminating the second drill string segment;

immobilizing the second drill string segment in the subterranean well bore; uncoupling the first drill string segment from the second drill string segment;

at least partially retracting the first drill string segment in the subterranean well bore away from the second drill string segment;

reinserting the first drill string segment in the subterranean well bore to the second drill string segment;

re-coupling the first drill string segment to the second drill string segment; and wherein uncoupling the first drill string segment from the second drill string segment comprises uncoupling an on/off tool on a lower end of the first drill string segment from a hang off tool on an upper end of the second drill string segment, and re-coupling the first drill string segment to the second drill string segment comprises re-coupling the on/off tool on the first drill string segment to the hang off tool on the second drill string segment.

2. The method of claim 1 further comprising terminating flow of hydrocarbon through the drill string to block flow of drill fluid through the drill string prior to uncoupling the first drill string segment from the second drill string segment.

3. The method of claim 1 wherein forming a subterranean well bore comprises forming a vertical subterranean well bore.

4. The method of claim 1 wherein forming a subterranean well bore comprises forming a non-vertical subterranean well bore.

5. A subterranean drill string coupling and uncoupling method, comprising:

forming a subterranean well bore by conducting a drilling operation using a drill string having a first drill string segment and a second drill string segment detachably coupled to the first drill string segment and a drill head terminating the second drill string segment;

immobilizing the second drill string segment in the subterranean well bore;

uncoupling the first drill string segment from the second drill string segment;

at least partially retracting the first drill string segment in the subterranean well bore away from the second drill string segment;

reinserting the first drill string segment in the subterranean well bore to the second drill string segment;

re-coupling the first drill string segment to the second drill string segment;

terminating flow of hydrocarbon through the drill string to block flow of drill fluid through the drill string prior to uncoupling the first drill string segment from the second drill string segment; and wherein terminating flow of hydrocarbon through the drill string comprises seating a ball in the drill string.

6. A subterranean drill string coupling and uncoupling method, comprising:

forming a subterranean well bore by conducting a drilling operation using a drill string having a first drill string segment and a second drill string segment detachably coupled to the first drill string segment and a drill head terminating the second drill string segment;

immobilizing the second drill string segment in the subterranean well bore;

uncoupling the first drill string segment from the second drill string segment;

at least partially retracting the first drill string segment in the subterranean well bore away from the second drill string segment;

reinserting the first drill string segment in the subterranean well bore to the second drill string segment;

re-coupling the first drill string segment to the second drill string segment; and wherein immobilizing the second drill string segment in the subterranean well bore comprises deploying expandable and retractable slips outwardly from the drill string to engage a well casing lining the subterranean well bore.

7. The method of claim 6 wherein uncoupling the first drill string segment from the second drill string segment comprises uncoupling an on/off tool on the first drill string segment from a hang off tool on the second drill string segment, and coupling the first drill string segment to the second drill string segment comprises coupling the on/off tool on the first drill string segment to the hang off tool on the second drill string segment, and wherein deploying expandable and retractable slips outwardly from the drill string comprises deploying expandable and retractable slips outwardly from the hang off tool.

8. A subterranean drill string coupling and uncoupling method, comprising:

forming a subterranean well bore by conducting a drilling operation using a drill string having a first drill string segment and a second drill string segment detachably coupled to the first drill string segment and a drill head terminating the second drill string segment;

placing a blowout preventer in the subterranean well bore;

immobilizing the second drill string segment in the subterranean well bore;

uncoupling the first drill string segment from the second drill string segment;

retracting the first drill string segment in the subterranean well bore away from the second drill string segment;

testing the blowout preventer using the first drill string segment by flowing well fluid through the first drill string segment and the blowout preventer, respectively;

reinserting the first drill string segment in the subterranean well bore to the second drill string segment;

re-coupling the first drill string segment to the second drill string segment;

de-immobilizing the second drill string in the subterranean well bore; and resuming the drilling operation.

9. The method of claim 8 wherein uncoupling the first drill string segment from the second drill string segment comprises uncoupling an on/off tool on the first drill string segment from a hang off tool on the second drill string segment, and coupling the first drill string segment to the second drill string segment comprises coupling the on/off tool on the first drill string segment to the hang off tool on the second drill string segment.

10. The method of claim 8 further comprising terminating flow of hydrocarbon through the drill string to block flow of drill fluid through the drill string prior to uncoupling the first drill string segment from the second drill string segment.

11. The method of claim 10 wherein terminating flow of hydrocarbon through the drill string comprises seating a ball in the drill string.

12. The method of claim 8 wherein immobilizing the second drill string segment in the subterranean well bore comprises deploying expandable and retractable slips outwardly from the drill string to engage a well casing lining the subterranean well bore.

13. The method of claim 12 wherein uncoupling the first drill string segment from the second drill string segment comprises uncoupling an on/off tool on the first drill string segment from a hang off tool on the second drill string segment, and coupling the first drill string segment to the second drill string segment comprises coupling the on/off tool on the first drill string segment to the hang off tool on the second drill string segment, and wherein deploying expandable and retractable slips outwardly from the drill string comprises deploying expandable and retractable slips outwardly from the hang off tool.

14. The method of claim 8 wherein forming a subterranean well bore comprises forming a vertical subterranean well bore.

15. The method of claim 8 wherein forming a subterranean well bore comprises forming a non-vertical subterranean well bore.

16. A subterranean drill string coupling and uncoupling method, comprising:

forming a subterranean well bore by conducting a drilling operation using a drill string having a first drill string segment, an on/off tool on the first drill string segment, a second drill string segment and a hang off tool on the second drill string segment and detachably coupled to the on/off tool on the first drill string segment and a drill head terminating the second drill string segment;

placing a blowout preventer in the subterranean well bore;

inserting the drill string through the blowout preventer;

immobilizing the hang off tool on the second drill string segment in the subterranean well bore distal to the blowout preventer;

uncoupling the on/off tool on the first drill string segment from the hang off tool on the second drill string segment;

retracting the first drill string segment in the subterranean well bore away from the second drill string segment and positioning the on/off tool proximal to the blowout preventer;

testing the blowout preventer using the on/off tool on the first drill string segment by flowing well fluid through the first drill string segment and the blowout preventer, respectively;

reinserting the first drill string segment through the blowout preventer to the second drill string segment;

re-coupling the on/off tool on the first drill string segment to the hang off tool on the second drill string segment;

de-immobilizing the hang off tool on the second drill string segment in the subterranean well bore; and resuming the drilling operation.

17. The method of claim 16 wherein immobilizing the second drill string segment in the subterranean well bore comprises deploying expandable and retractable slips outwardly from the hang off tool to engage a well casing lining the subterranean well bore.

18. The method of claim 16 wherein forming a subterranean well bore comprises forming a vertical subterranean well bore.

19. The method of claim 16 wherein forming a subterranean well bore comprises forming a non-vertical subterranean well bore.

* * * * *